US007314439B2

(12) United States Patent
Bossel et al.

(10) Patent No.: US 7,314,439 B2
(45) **Date of Patent: *Jan. 1, 2008**

(54) PROCESS FOR MANUFACTURING A POUCH-TYPE FORM OF PACKAGING

(75) Inventors: Daniel Bossel, Schaffhausen (CH); Kyeni Mbiti, Zurich (CH); Jochem Willemse, Zurich (CH); Peter Kanscar, Zurich (CH)

(73) Assignee: Alcan Technology & Management Ltd., Neuhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 11/640,347

(22) Filed: Dec. 18, 2006

(65) Prior Publication Data

US 2007/0099784 A1 May 3, 2007

Related U.S. Application Data

(62) Division of application No. 11/011,155, filed on Dec. 15, 2004, now Pat. No. 7,169,102.

(30) Foreign Application Priority Data

Dec. 23, 2003 (EP) ..... 03405926

(51) Int. Cl.
*B31B 1/64* (2006.01)

(52) U.S. Cl. ..... 493/189; 493/193; 493/197; 53/133.1

(58) Field of Classification Search ..... 493/189, 493/193, 198, 212, 195, 295, 296; 53/133.1, 53/133.2, 456
See application file for complete search history.

(56) References Cited

U.S. PATENT DOCUMENTS 2,942,760 A 6/1960 Schneider, I 2,952,394 A 9/1960 Schneider, III (Continued)

FOREIGN PATENT DOCUMENTS

EP 03405926 7/2004

(Continued)

*Primary Examiner*—Hemant M. Desai
(74) *Attorney, Agent, or Firm*—Fisher, Christen & Sabol

(57) ABSTRACT

A process for manufacturing a tetrahedral-shaped pouch (100 from a flexible strip of film material is such that a tube (13) is formed from a strip (32) in a continuous manner involving the creation of a longitudinal sealing seam (12), and a tetrahedral shaped pouch (10) is formed from the tube (13) by means of alternating forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed as its free end (22) is formed projecting out from the pouch (10). The second transverse seams (16) are positioned such that the outlet parts (20, 20') projecting out from two neighboring tetrahedral shaped pouched (10, 10') are delimited by regions (16*a*, 16*a*') of neighboring transverse sealing seams (16, 16') that are arranged spaced apart from each other and their free ends (22) lie facing each other separated by a common part (16*b*) of the transverse sealing seams (16, 16').

8 Claims, 3 Drawing Sheets

U.S. PATENT DOCUMENTS

| | | | | |
|---|---|---|---|---|
| 3,038,649 | A | | 6/1962 | Rausing |
| 3,074,612 | A | | 1/1963 | Schneider, II |
| 3,083,876 | A | | 4/1963 | Schneider et al. |
| 3,612,133 | A | | 10/1971 | Jarund |
| 3,618,758 | A | * | 11/1971 | Shaw et al. ..... 206/436 |
| 3,791,570 | A | | 2/1974 | Hopkins |
| 3,925,959 | A | | 12/1975 | Dykes et al. |
| 4,301,927 | A | | 11/1981 | Carlsson et al. |
| 4,644,732 | A | | 2/1987 | Morton |
| 5,312,189 | A | | 5/1994 | Aeschbach et al. |

FOREIGN PATENT DOCUMENTS

| | | |
|---|---|---|
| FR | 1065305 | 5/1954 |
| FR | 2686572 | 7/1993 |
| JP | 2000- 72155 | 3/2000 |
| JP | 2005-271964 | 10/2005 |
| WO | 03/095327 | 11/2003 |

* cited by examiner

PROCESS FOR MANUFACTURING A POUCH-TYPE FORM OF PACKAGING

This U.S. application is a division of U.S. Ser. No. 11/011,155, filed on Dec. 15, 2004 now U.S. Pat. No. 7,169,102, issued on Jan. 30, 2007, that has priority benefit of European Patent Application No. 03405926.1, filed on Dec. 23, 2003.

The invention relates to a process for manufacturing a pouch-type, tetrahedral-shaped form of packaging of a flexible strip of film material, in which process a tube is formed from a film strip in a continuous manner involving the creation of a longitudinal sealing seam, and the tetrahedral shaped pouch is formed from the tube by means of alternatingly forming a first transverse sealing seam running transverse to the longitudinal seam and second transverse sealing seam running essentially perpendicular to and a distance from the first transverse seam, whereby the second transverse seams are situated in the region of a tetrahedral corner of the pouch, such that an essentially tube shaped part for pouring that is closed at its free end is formed projecting out from the pouch.

Tetrahedral shaped pouch-type forms of packaging made from plastic-coated cardboard are known. To remove the fluid contents, the pouch is provided with an opening which is closed off e.g. by means of a film which can be penetrated by a drinking straw. Other pouches can be torn open along a perforation line to form an opening for pouring. Also known are tetrahedral shaped pouches of a flexible film-type material for chocolate sweets filled with a sugar-based mass. As is the case with many pouch-type forms of packaging, a notch to initiate tearing is provided in a sealing seam for opening purposes.

A process of the kind mentioned at the start is disclosed in U.S. Pat. No. 2,942,760.

The object of the invention is to develop further a process of the kind mentioned at the start such that the pouch-type packaging can be manufactured in a simple, rational manner creating as little waste material as possible and providing a simple means for reclosing the packaging.

That objective is achieved by way of the invention in that the second transverse seams are positioned such that the pouring outlet parts projecting out from two neighbouring tetrahedral shaped pouches are delimited by partial regions of neighbouring transverse sealing seams that are arranged spaced apart from each other and their free ends lie facing each other separated by a common part of the transverse sealing seams.

A preferred process is such that the neighbouring transverse seams and the partial regions are arranged in a mirror image fashion with respect to the common partial region, and the neighbouring transverse seams and the partial regions delimit a separable section of film.

By means of the arrangement of an outlet part projecting from the pouch in the region of a tetrahedral corner, a pouch-type form of packaging with a multifunctional opening is achieved which is suitable both as an opening for drinking and for the controlled removal of fluids and pourable solids. Added to this are the advantages of the tetrahedral shape of the pouch which lies easily in the hand and is extremely stable in shape and with respect to self-standing properties. A further advantage is that a pouch that has already been opened and has an outlet part lying opposite the tetrahedral-shaped base area can be laid down on a surface e.g. a table without the fluid running out, as in this position the outlet opening is seated at the highest point of the pouch.

In a preferred version provision is made for the tube-shaped outlet part to taper in a conical manner away from the tetrahedral corner of the pouch in the direction of pouring. The conical form of the outlet part has the advantage that, for example on opening with scissors, the cross-section of the opening created by cutting away the closed end of the outlet part transverse to the direction of pouring becomes larger with increasing distance of the cut from the free end of the outlet part. This way it is possible to create an opening for controlled removal of contents that is individually suited for a particular purpose.

To make the opening of the pouch easier—without scissors or knife—at least one notch to aid tearing may be provided running transverse to the direction of pouring whereby, in a particularly useful form of outlet, at least two tearing-aid notches may be provided a different distance from the closed free end of the outlet part in order to create openings of different cross-section. In order to obtain an opening with as well defined cross-section as possible, lines of weakness may be provided in addition to the notches to aid tearing. The lines of weakness begin at the tip of the notches and run around the outlet part.

In the unopened pouch the outlet part projecting from the a tetrahedral corner of the pouch may e.g. be folded against one of the faces of the pouch and be fixed in the folded position by means of adhesive means on the pouch face or on the outlet part. This way the outlet part is relatively well protected against mechanical damage during transport and storage. After opening the pouch by separating the outlet part in the region of its free end, there is—via suitable arrangement of the adhesive means in conjunction with the ease of folding or tilting of the outlet part—a simple possibility for closing the opened pouch again. By means of this simple closure, at least in the case of pourable solids, it is possible effectively to prevent the contents running out of the pouch if it is tipped over.

In particular when using the pouch to hold drinks it may prove useful to provide a reinforcing element, preferably a tube-shaped piece made of plastic, in the outlet part. In particular in the case of a pouch-type container for drinks, the tube-shaped part takes on the function of a drinking straw. In a preferred version the outlet part is not permanently attached to the tube-shaped part from its closed end to a tearing-aid notch or tearing line so that on opening the pouch the outlet part, after separation from the pouch, can be removed via the tube-shaped part. Thereby, the bacteria-free tube-shaped part can be exposed and can be introduced into-the mouth without touching.

The transverse sealing seam is situated such that a conical pouring outlet pointing tapering away from the pouch is formed.

To enable the pouch to be opened easily without scissors or a knife, at least one notch for initiating tearing may be provided in the transverse seam in the region of the free end of the pouring outlet transverse to the direction of pouring. In order to prepare pouring outlets or controlled dispensing openings of different opening cross-section, at least two notches for initiating tearing are usefully provided at different distances from the closed free end of the pouring outlet. In order to maintain as well defined as possible cross-section of opening, lines of weakness may be provided starting from the notches and running round the outlet part—these in addition to the said tearing notches. Further, a reinforcing element—preferably a tubular piece of plastic material—may be provided in the outlet part.

Preferred contents for the packaging in question include drinks of all kinds and pourable solids such as e.g. Corn flour, semolina and the like granular foodstuffs and washing powders.

BRIEF DESCRIPTION OF THE DRAWINGS

Further advantages, features and details of the invention are revealed in the following description of preferred exemplified embodiments and with the aid of the drawing which shows schematically in FIG. 1 the continuous production of packaging pouches in the form of tubular pouches with longitudinal sealing seam.

DETAILED DESCRIPTION OF THE INVENTION

Figure 1:
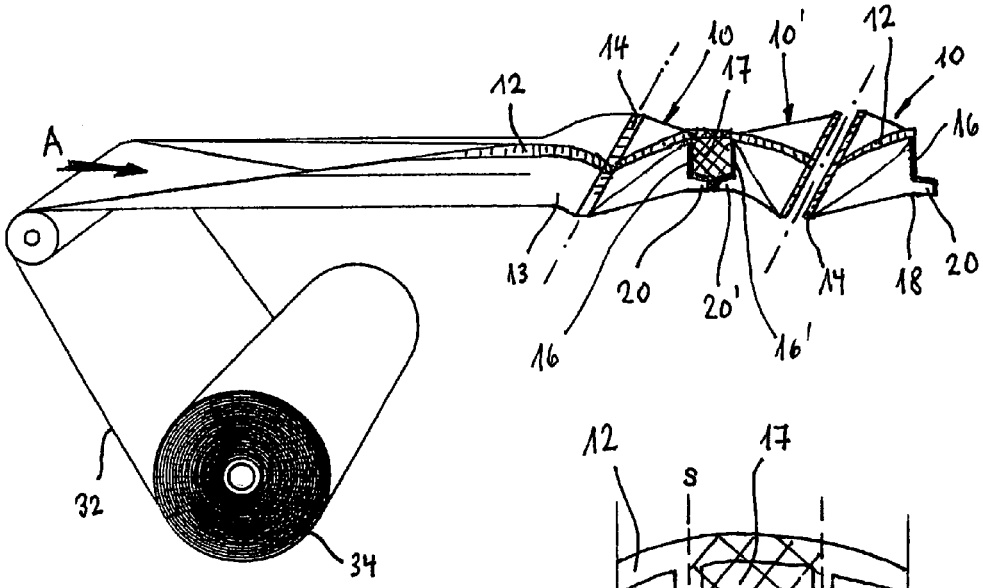
Figure 2:
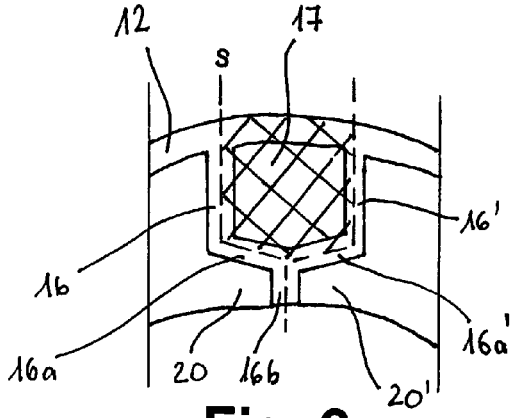
FIG. 2 an enlarged detail of FIG. 1.

As shown in FIG. 1 a film strip 32 for manufacturing tetrahedral packaging pouches 10 is uncoiled from a feed roll 34 and shaped continuously in a conventional manner—in a facility not described in greater detail here—to form a tube 13 with a longitudinal seam 12. After creating a first transverse seam 14, the contents can be introduced in the direction of the arrow A. Although in the drawing the film-type tube 13 runs in the horizontal direction, it is of course understood that the introduction of fluid or pourable solid contents takes place in the vertical direction. After each introduction of contents, in addition to the continuous longitudinal seam 12, a second transverse seam 16 that closes the packaging is formed, whereby each successive transverse seam 14, 16 is turned an angle of 90° thus forming a tetrahedron In the production of containers 10, as shown in FIG. 1, one of the transverse seams is placed—shown in detail in FIG. 2—such that an outlet part 20 is formed in the region of one of the corners 18 of the tetrahedron formed. The second transverse seam 16 formed in the plane of the longitudinal seam 12 runs initially in a first region 16*a* corresponding to the desired tetrahedron shape. In the region of the corner 18 of the container is a first seam region 16*a* which runs in the direction of pouring y of the outlet part 20, which as a result is tubular in shape. A second region 16*b* of the second transverse seam 16 runs essentially parallel to the original direction of the seam and serves to close off the outlet part 20 which is here conical at its free end 22.

In the present example the outlet parts 20, 20' in two subsequent pouches 10 10' point in opposite directions, and between the corresponding transverse seams 16, 16' there is a length of film 17 which, after separating the pouches 10, 10' along line s, is discarded. In the production of the pouches according to the invention there are of course other possible counterposing arrangements of outlet parts in two successive pouches.

Figure 3:
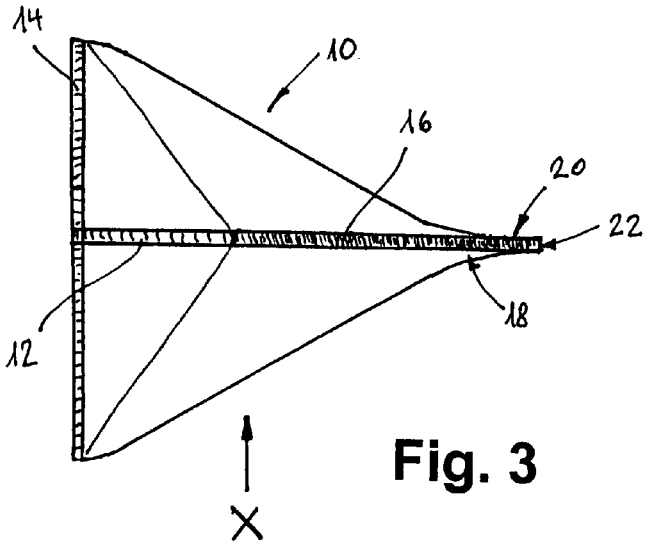
FIG. 3 plan view of a packaging pouch manufactured using the process shown in FIG. 1.
Figure 4:
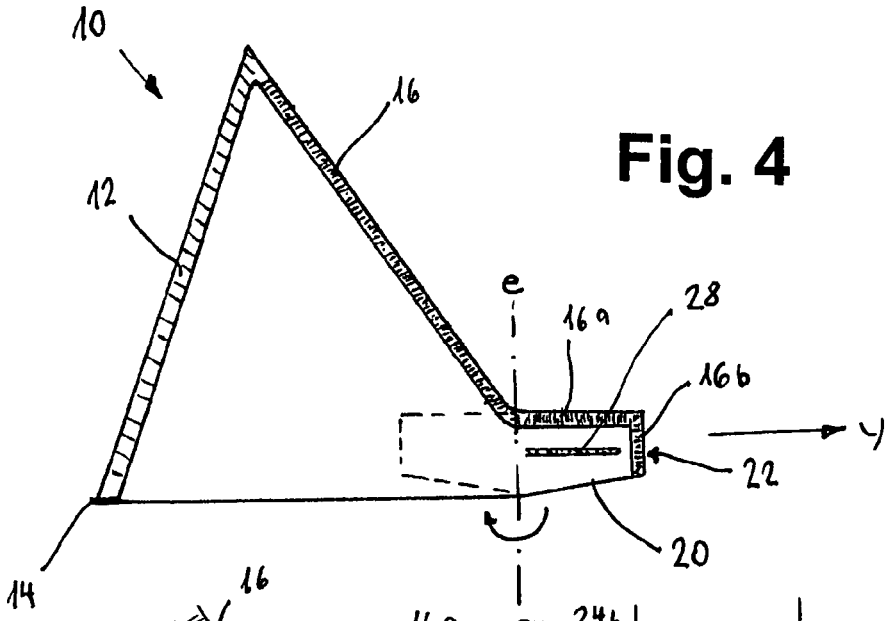
FIG. 4 side view of the packaging pouch in FIG. 3 as viewed in the direction X.

The pouches 10 formed between successive transverse seams 14, 16 are cut into individual pouches in a cutting facility which is not shown here. A single pouch 10 is shown in FIGS. 3 and 4.

Figure 5:
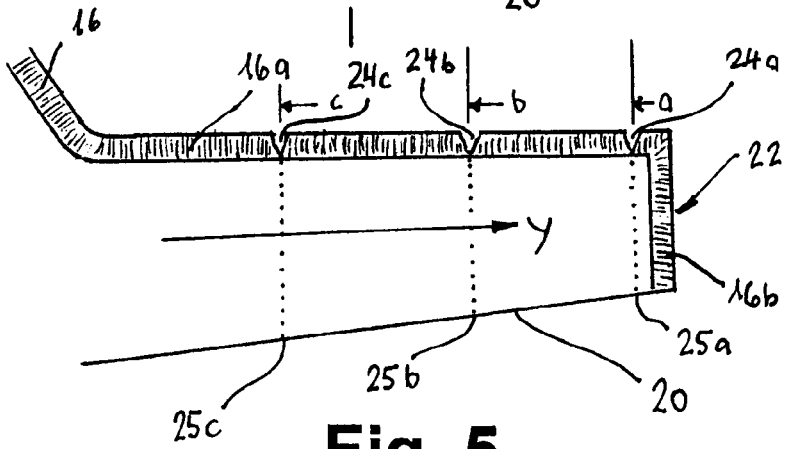
FIG. 5 an enlarged detail of FIG. 4.

An outlet part 20, shown in FIG. 5, is conical in shape towards its closed free end 22 and features tearing notches 24*a,b,c* running transverse to the pouring direction y in the region 16*a* of the transverse seam at different distances a, b, c, from the closed end 22. Running away from the tip of each tearing notch 24*a,b,c* and round the outlet part 20 is a line of weakness 25*a,b,c* e.g. in the form of a cut which does not penetrate the full thickness of the film material, or in the form of perforations which follow a line but do not penetrate the full thickness of the film material. Depending on the size of opening cross-section desired, the outlet part 20 is separated along the appropriate line of weakness 25*a,b,c* starting from the related tearing notch 24*a,b,c*.

In order to prevent mechanical damage to the outlet part 20 during transport and storage, and accidental spillage of contents after the pouch has been opened, the outlet part can be folded or tilted about an axis e transverse to the direction of pouring y. In order to fix the folded outlet part 20 to the pouch (indicated by broken lines in FIG. 4) adhesive 28 is provided; in the example here in the form of an adhesive strip on the outlet part 20.

Figure 6:
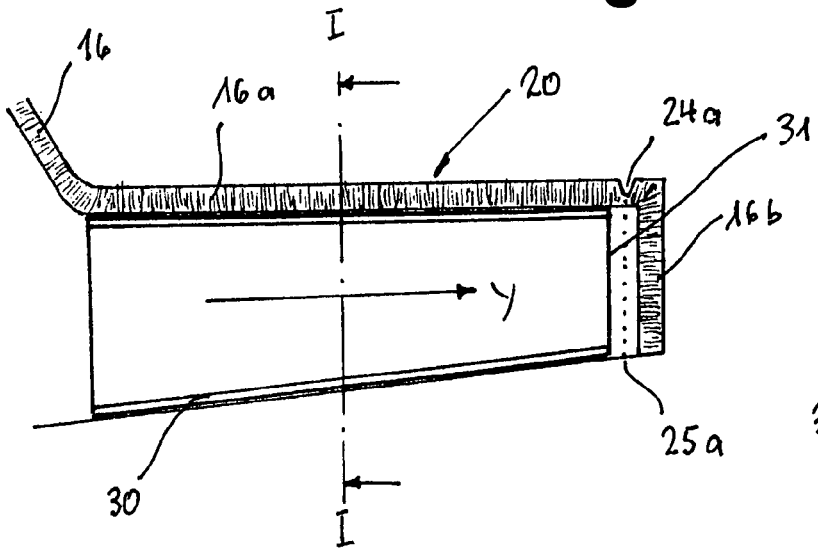
FIG. 6 a longitudinal section through an outlet part featuring a reinforcing piece.
Figure 7:
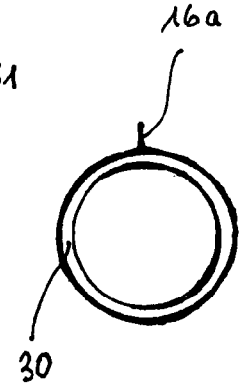
FIG. 7 cross-section through the outlet part in FIG. 6 along line I-I.

In the version of outlet part 20 shown in FIGS. 6 and 7 a reinforcing element is provided in the form of a conically tapering tube 30 of plastic material. Opening the pouch is performed via the tearing notch 24*a* immediately ahead of the tip 31 of the tube 30. If an opening of larger cross-section is desired, then the tube can be cut further back e.g. using scissors.

Figure 8:
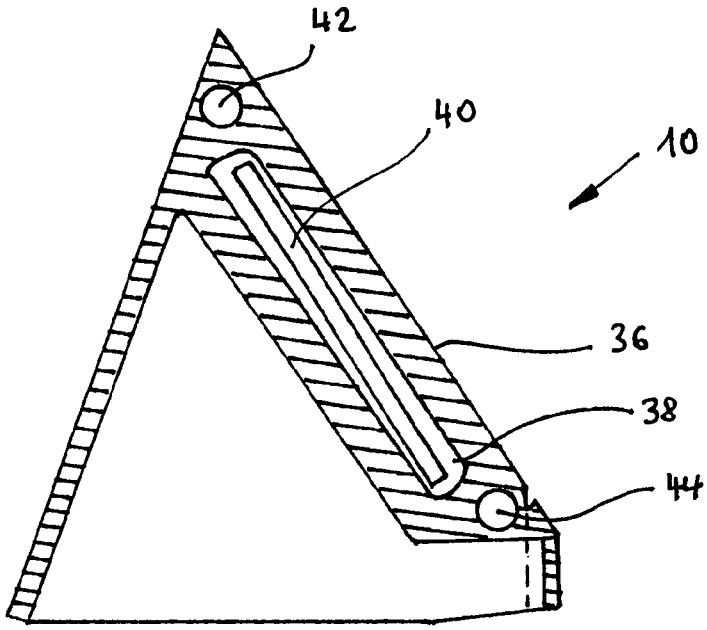
FIG. 8 a side view of a further version of a packaging pouch.

In the pouch 10 shown in FIG. 8, instead of the narrow transverse seam 16 there is a broader transverse seam 36. This broad seam region 36 corresponds to a part of the film section 17 which results during the manufacture of the pouch according to FIG. 1, which instead of being removed is used further. In the example shown the sealing region 36 comprises an unsealed region serving as space 38 for a drinking straw 40. The space may of course have any desired shape and serve to accommodate any desired object. Further, two holes 42, 44 have been stamped out in the sealing region 36 e.g. to enable the pouch 10 to be hung up in a display shelf.

Figure 9:
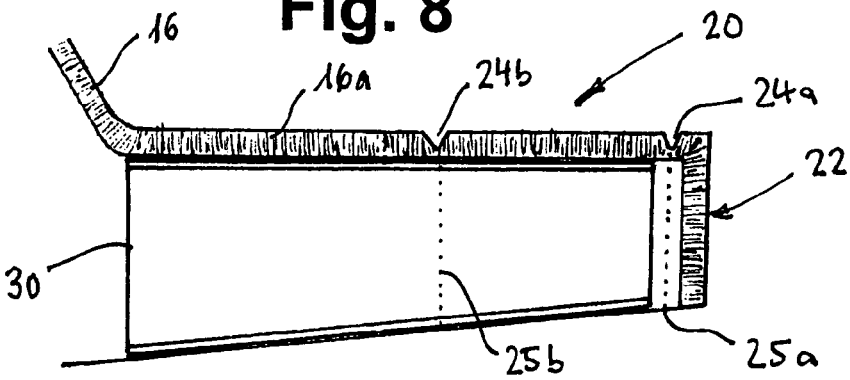
FIG. 9-11 an outlet part with tubular reinforcing piece during opening.
Figure 10:
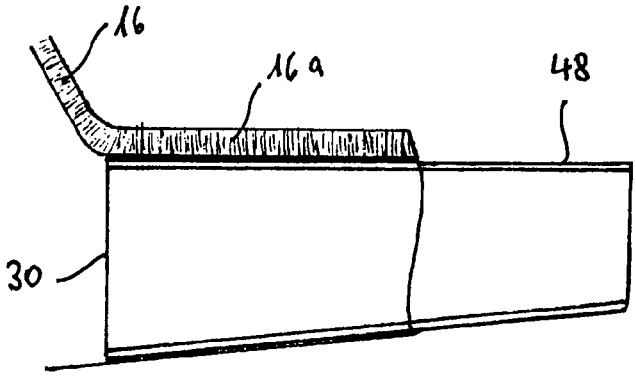
Figure 11:
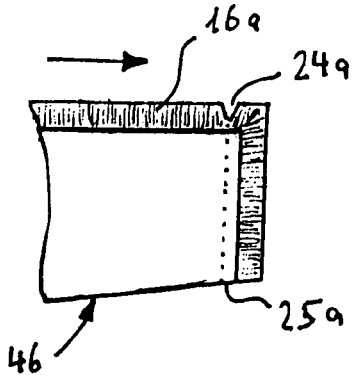

In the case of an outlet part 20 with tube 30 as reinforcement element shown in FIGS. 9 to 11 the tube 30 is not permanently attached to the outlet part 20 from the free end 22 of the outlet part 20 up to a tearing notch 24*b*. In order to open the outlet part 20 this is separated from the rest of the pouch at the tearing notch 24*b* and removed as waste 46 (FIG. 11) over the tube 30. Thereby, as shown in FIG. 10, in the case of a drinks container one end 48 of the tube 30 takes on the function of a bacteria-free drinking straw which, after tearing off the separable part 46, can be introduced directly to the mouth. Drinking pouches with such an outlet are e.g. suitable for use in regions where the hygienic conditions are poor and hence the risk of infection is high.

The invention claimed is:

1. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a'*) of neighboring transverse sealing seams (16,16') that are arranged spaced apart from each other and their free ends (22) lie facing each other separated by a common part (16*b*) of the transverse sealing seams (16, 16'), at least one notch (24*a*) as aid to tearing and running transverse to the direction of pouring (y) is provided in the transverse seam (16*a*, 16*a'*) in the region of the closed free end (22) of the outlet part (20, 20').

2. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a'*) of neighboring transverse sealing seams (16, 16') that are arranged spaced apart from each other and their free ends (22) lie facing each other separated by a common part (16*b*) of the transverse sealing seams (16, 16'), the neighboring transverse seams (16, 16') and the regions (16*a*, 16*a'*) are arranged in a mirror image fashion with respect to their common region (16*b*), and regions (16*a*, 16*a'*) delimit a removable section of film (17), the transverse seams (16, 16') are arranged such that a conical tapering outlet part (20, 20') pointing away from the pouch (10, 10') in the direction of pouring (y) is produced.

3. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a'*) of neighboring transverse sealing seams (16, 16') that are arranged spaced apart from each other and their free ends (22) lie facing each other separated by a common part (16*b*) of the transverse sealing seams (16, 16'), the neighboring transverse seams (16, 16') and the regions (16*a*, 16*a'*) are arranged in a mirror image fashion with respect to their common region (16*b*), at least one notch (24*a*) as an aid to tearing and running transverse to the direction of pouring (y) is provided in the transverse seam (16*a*, 16*a'*) in the region of the closed free end (22) of the outlet part (20, 20').

4. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a'*) of neighboring transverse sealing seams (16, 16') that are arranged spaced apart from each other and their free ends (22) lie facing each other separated by a common part (16*b*) of the transverse sealing seams (16,16'), the neighboring transverse seams (16, 16') and the regions (16*a*, 16*a'*) are arranged in a mirror image fashion with respect to their common region (16*b*), the neighboring transverse seams (16, 16') and regions (16*a*, 16*a'*) delimit a removable section of film (17), at least one notch (24*a*) as an aid to tearing and running transverse to the direction of pouring (y) is provided in the transverse seam (16*a*, 16*a'*) in the region of the closed free end (22) of the outlet part (20, 20').

5. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a'*) of neighboring transverse sealing seams (16, 16') that are arranged spaced apart from each other and their free ends (22) lie facing each other separated by a common part (16*b*) of the transverse sealing seams (16, 16'), the transverse seams (16, 16') are arranged such that a conical tapering outlet part (20, 20') pointing away from the pouch (10, 10') in the direction of pouring (y) is produced, at least one notch (24*a*) as an aid to tearing and running transverse to the direction of pouring (y) is provided in the transverse seam (16*a*, 16') in the region of the closed free end (22) of the outlet part (20, 20').

6. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (20) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16, 16*a*') of neighboring transverse sealing seams (16, 16') that are arranged spaced apart from each other and their ends (22) lie facing each other separated by a common part (16*b*) of the transverse sealing seams (16, 16'), at least one notch (24*a*) as an aid to tearing and running transverse to the direction of pouring (y) is provided in the transverse seam (16, 16*a*') in the region of the closed free end (22) of the outlet part (20, 20'), at least two tearing notches (24*a,b,c*) are provided at different distances (a,b,c) from the closed free end (22) of the outlet part (20, 20') for the purpose of forming outlet openings (25*a,b,c*) with different sizes of cross-section, lines of weakness (a,b,c) running round the outlet part (20, 20') are provided in the outlet part (20, 20') starting from the tearing notches (24*a,b,c*).

7. A process for manufacturing a tetrahedral-shaped pouch (10) from a flexible strip of film material, in which process a tube (13) is formed from a film strip (32) in a continuous manner involving the creation of a longitudinal sealing seam (12), and the tetrahedral shaped pouch (10) is formed from the tube (13) by means of alternatingly forming a first transverse sealing seam (14) running transverse to the longitudinal seam (12) and second transverse sealing seam (16) running essentially perpendicular to and a distance from the first transverse seam (14), whereby the second transverse seams (16) are situated in the region of a tetrahedral corner (18) of the pouch (10), such that an essentially tube outlet part (2) for pouring that is closed at its free end (22) is formed projecting out from the pouch (10), the second transverse seams (16) are positioned such that the outlet parts (20, 20') projecting out from two neighboring tetrahedral shaped pouches (10, 10') are delimited by regions (16*a*, 16*a*') of neighboring transverse sealing seams (16, 16') that are arranged spaced apart from each other and their free ends (22) lie facing each other separated by a common part (16*b*) of the transverse sealing seams (16, 16'), the neighboring transverse seams (16, 16') and the regions (16*a*, 16*a*') are arranged in a mirror image fashion with respect to their common region (16*b*), a reinforcing Element (30) a tube-shaped piece of plastic material is provided in the outlet part (20, 20').

8. The process according to claim 7, wherein the reinforcing element (30) is a tube-shaped piece of plastic material.

* * * * *